US007150692B2

(12) United States Patent
Hong

(10) Patent No.: US 7,150,692 B2
(45) Date of Patent: Dec. 19, 2006

(54) SPORT GOOD OF COMPOSITE MATERIAL WITH LIGHTER WEIGHT AND GREATER RIGIDITY

(76) Inventor: Arthur Hong, No. 153, Sec. 3, Chung San Road, Tan Tsu Hsian, Taichung Hsien (TW)

( * ) Notice: Subject to any disclaimer, the term of this patent is extended or adjusted under 35 U.S.C. 154(b) by 43 days.

(21) Appl. No.: 10/976,796

(22) Filed: Nov. 1, 2004

(65) Prior Publication Data

US 2006/0094546 A1 May 4, 2006

(51) Int. Cl.

| | |
|---|---|
| ***A63B 59/14*** | (2006.01) |
| *A63B 59/06* | (2006.01) |
| *A63B 59/04* | (2006.01) |
| *A63C 5/00* | (2006.01) |

(52) U.S. Cl. ..... 473/561; 473/567; 473/527; 280/601

(58) Field of Classification Search ..... 473/560–568
See application file for complete search history.

(56) References Cited

U.S. PATENT DOCUMENTS

| | | | | |
|---|---|---|---|---|
| RE31,811 | E * | 1/1985 | Foreman | 473/566 |
| 5,827,142 | A * | 10/1998 | Rappaport | 473/567 |
| 5,897,448 | A * | 4/1999 | Chang | 473/552 |
| 6,007,439 | A * | 12/1999 | MacKay, Jr. | 473/520 |
| 6,361,451 | B1 * | 3/2002 | Masters et al. | 473/318 |
| 2004/0082413 | A1 * | 4/2004 | Leal et al. | 473/564 |

FOREIGN PATENT DOCUMENTS

JP 52037126 A * 3/1977

* cited by examiner

*Primary Examiner*—Mark S. Graham
(74) *Attorney, Agent, or Firm*—Browdy and Neimark, PLLC

(57) ABSTRACT

A sport good, such as hockey stick, Ping-Pong bat, baseball bat, ski stick and so on, has a rigid member made of a composite material. The rigid member has a chamber therein, in which a high-pressure gas is filled to make the sport good having both properties of lighter weight and greater rigidity.

1 Claim, 4 Drawing Sheets

SPORT GOOD OF COMPOSITE MATERIAL WITH LIGHTER WEIGHT AND GREATER RIGIDITY

BACKGROUND OF THE INVENTION

1. Field of the Invention

The present invention relates generally to a sport good, and more particularly to a sport good, which is made of a composite material and has both properties of lighter weight and greater rigidity.

2. Description of the Related Art

Each sport has its specific goods, such as hockey stick, golf club, baseball bat, Ping-Pong bat, tennis or badminton racket and so on. These goods usually have a hollow member for reduction of weight, such that the user can use it easily, but the hollow member also reduces the rigidity thereof, which means the hollow member is easier to be deformed when swings it.

The manufacturers of the sport goods are trying to design the sport good with both of lighter weight and greater rigidity. Most of them are provided with extra structure to increase the rigidity thereof, but the cost thereof is raised and the extra structure increases the weight still. There is no such a design can get the sport goods with both of the lighter weight and greater rigidity.

SUMMARY OF THE INVENTION

The primary objective of the present invention is to provide a sport good, which has both properties of lighter weight and greater rigidity.

According to the objective of the present invention, a sport good comprises a rigid member made of a composite material. The rigid member has a chamber therein, in which a high-pressure gas is filled.

DETAILED DESCRIPTION OF THE INVENTION

Figure 1:
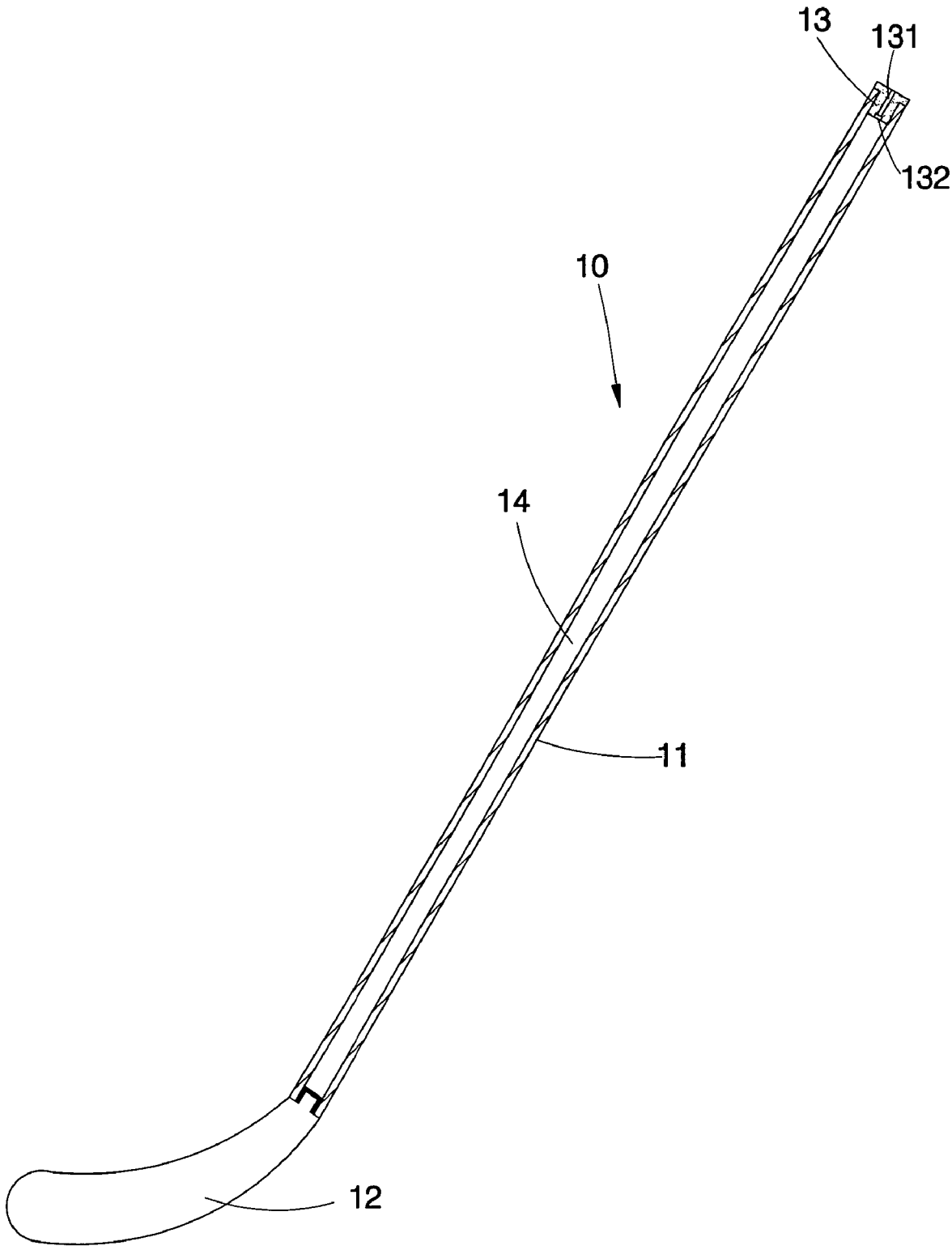
FIG. 1 is a sectional view of a first preferred embodiment of the present invention, showing a hockey stick.
Figure 2:
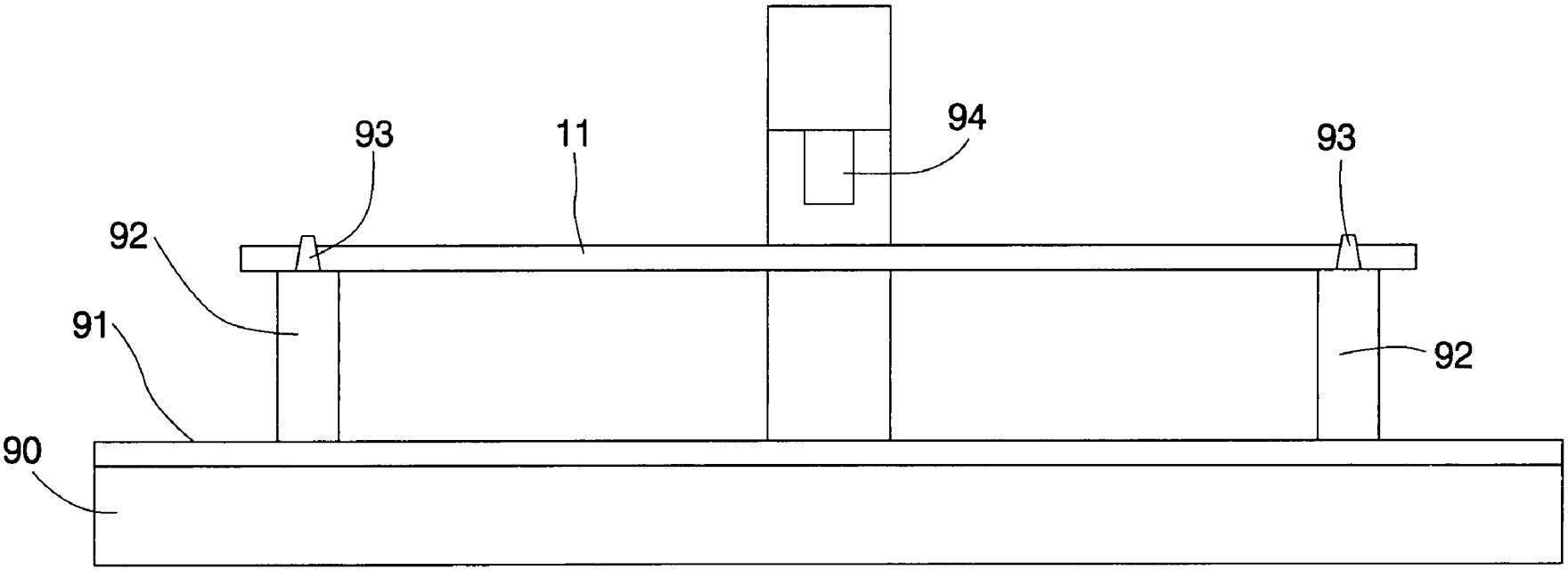
FIG. 2 is a sectional view of the equipment to measure the pressure inside the hockey stick of the first preferred embodiment of the present invention.

As shown in FIG. 1, a sport good of the first preferred embodiment of the present invention is a hockey stick 10, which has a shaft 11 and a blade 12. The shaft 11 is a hollow rigid member and made of a composite material having a chamber 14 therein. The blade 12 is connected to an end of the shaft 11 and on the other end of the shaft, an opening is provided to be communicated with the chamber 14 and a plunger 13 is provided in the opening. The plunger 13 has an airway 131, in which a check valve 132 is provided. Gas is issued into the chamber 14 via the airway 131 of the plunger 13 and the check valve 132 prevents the chamber 14 from leakage. The chamber 14 is inflated with the gas until it has a predetermined pressure in the chamber 14.

The shaft 11 of the hockey stick 10 filled with the high-pressure gas has a greater rigidity and keeps the lighter weight still. The inventor tests the relationship of the pressure in the chamber 14 and the rigidity of the shaft 11 and the test is described hereunder. A table 90 is provided, which has a rail 91 thereon, two frame 92 on the rail 91 and two clip devices 93 are provided on a top of each of the frame 92. The table 90 further has an arm 94 on a center of a top of the rail 91 and a sensor (not shown) to sense the pressure of the exertion of the arm 94 and the displacement of the arm 94.

In the beginning of the test, the frames 92 are adjusted to have a suitable interval to put the shaft 11 therebetween and clip it by the clip devices clip 93, and then the arm 94 is aligned to the center of shaft 11 and to the centers of the frames 94 as well.

Operator sets the pressure of the arm 94 and the arm 94 presses the shaft 11 to make a deformation of the shaft 11. The sensor measures the displacement of the arm 94, which is identical to the deformation of the shaft 11, to have the valve of the deformation of the shaft 11. The arm 94 presses the shaft until a specific deformation of the shaft is arrived, and then records the valve of the arm. The arm 94 presses the shafts with/without high-pressure gas therein and the values of the pressure of the arm are listed in the table hereunder:

| Item | Pressure in the shaft | Pressure of the arm |
|---|---|---|
| 1 | no high-pressure gas issued | 13.47 KN/M$^2$ |
| 2 | high-pressure gas issued (8 kg/cm$^2$) | 19.97 KN/M$^2$ |

According to the table, the shaft with high-pressure gas has a greater resistance to the pressure than the shaft without high-pressure gas, which means the shaft with high-pressure gas has a greater rigidity.

Figure 3:
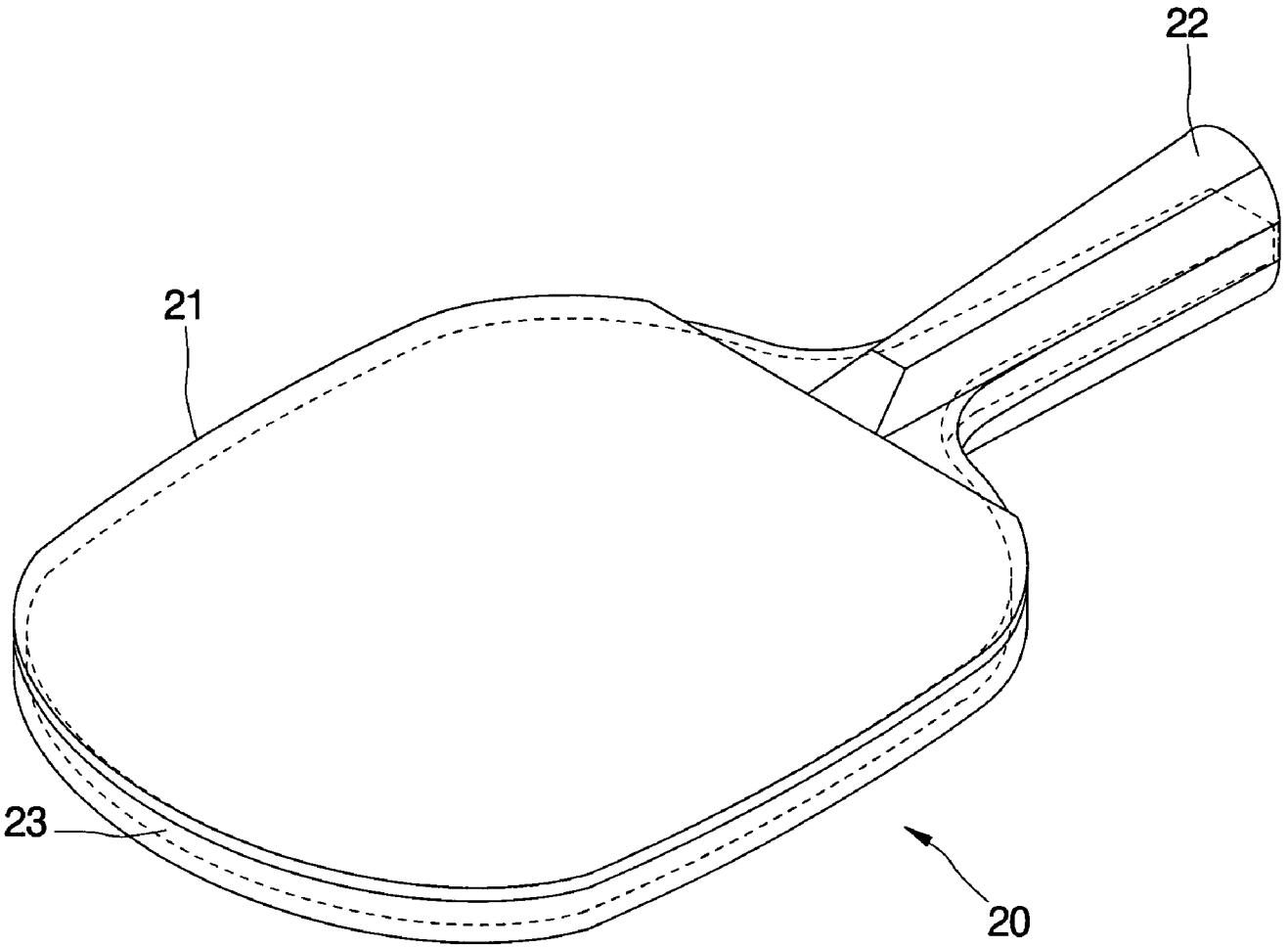
FIG. 3 is a perspective view of a second preferred embodiment of the present invention, showing a Ping-Pong bat, and FIG. 4 a perspective view of a third preferred embodiment of the present invention, showing a baseball bat.

As shown in FIG. 3, the second preferred embodiment of the present invention provides a Ping-Pong bat 20 consisted of a paddle 21 and a handle 22. The bat 20 is made of carbon-fibre composite material into a rigid member and has a chamber 23 therein. A high-pressure gas is issued in the chamber 23.

Figure 4:
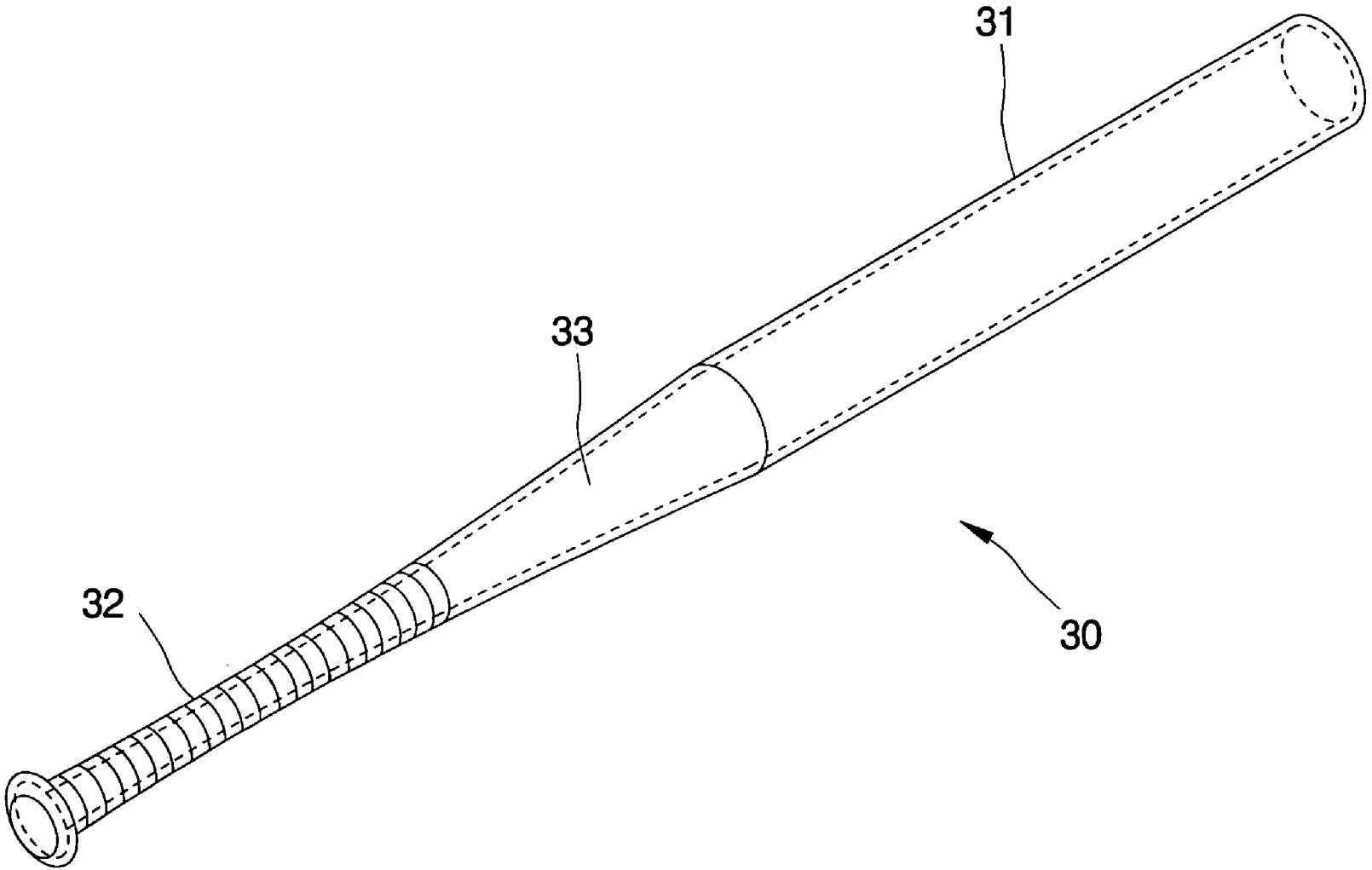

As shown in FIG. 4, the third preferred embodiment of the present invention provides a baseball bat 20 consisted with a bat portion 31 and a handle portion 32, in which a chamber 33 is formed and a high-pressure gas is filled therein.

The sport goods illustrated in the above preferred embodiments are a few examples, any sport goods, such as golf club, tennis racket, badminton racket, ski stick and so on, which needs properties of lighter weight and greater rigidity, can inflate high-pressure gas in the chamber thereof as described above. The sport good could be provided with a plurality of independent chambers therein and each chamber is issued with high-pressure gas.

What is claimed is:

1. A hockey stick, comprising:

a rigid hollow shaft made from a carbon-fiber composite material having only a single chamber therein, and a blade which is not hollow fixed to seal the opening at a first end of the hollow shaft;

wherein a plunger having an airway therethrough with a check valve therein closes a second end of the hollow shaft; and wherein said single chamber is filled with a high-pressure gas at 8 Kg/cm$^2$.

* * * * *